United States Patent [19]
Prengaman et al.
[11] 4,230,545
[45] Oct. 28, 1980

[54] PROCESS FOR REDUCING LEAD PEROXIDE FORMATION DURING LEAD ELECTROWINNING

[75] Inventors: Raymond D. Prengaman, Arlington; Herschel B. McDonald, Red Oak, both of Tex.

[73] Assignee: RSR Corporation, Dallas, Tex.

[21] Appl. No.: 93,514

[22] Filed: Nov. 13, 1979

[51] Int. Cl.[3] ..... C25C 1/18
[52] U.S. Cl. ..... 204/114
[58] Field of Search ..... 204/114

[56] References Cited

U.S. PATENT DOCUMENTS

| | | | |
|---|---|---|---|
| 679,824 | 8/1901 | Betts | 204/114 |
| 1,913,985 | 6/1933 | Harper et al. | 204/114 |
| 2,509,918 | 5/1950 | Griffith et al. | 204/114 |

*Primary Examiner*—R. L. Andrews
*Attorney, Agent, or Firm*—Watson, Leavenworth, Kelton & Taggart

[57] ABSTRACT

An electrolyte and a process for reducing lead peroxide formation when electrowinning lead from inorganic acid solutions are disclosed. In accordance with the invention, arsenic is added to an inorganic acid electrolyte containing lead, whereby oxygen is evolved at the anode while lead peroxide formation is reduced or eliminated during electrolysis.

14 Claims, No Drawings

PROCESS FOR REDUCING LEAD PEROXIDE FORMATION DURING LEAD ELECTROWINNING

BACKGROUND OF THE INVENTION (1) Field of the Invention

This invention relates to electrowinning lead employing an arsenic additive in the electrolyte to reduce lead peroxide formation on the anode.

(2) Description of the Prior Art

Electrowinning of lead from acid solutions has been proposed for years. However, the deposition of $PbO_2$ on the anode at the same time that lead is deposited at the cathode has been an obstacle in electrowinning lead from acid solutions. Since it is difficult to evolve oxygen at the anode at the lower current densities normally employed in electrowinning, stoichiometric amounts of $PbO_2$ are typically deposited on the anode as lead is deposited on the cathode.

The $PbO_2$ deposited on the anode must be removed and reprocessed to produce the desired metallic lead product. However, because $PbO_2$ is insoluble in most acid or alkaline solutions, it must be reduced either in a chemical or pyrometallurgical reaction to PbO or another lead salt which is soluble in the electrolyte before electrolytic reduction to lead can be accomplished. Further, since $PbO_2$ is generally formed in plates which adhere to the anode, removal and granulation thereof is typically required for efficient reduction in chemical processes. With pyrometallurgical techniques the anode deposit must be heated to elevated temperatures or in the presence of carbon to reduce the $PbO_2$ to PbO. Since the amount of lead contained in the $PbO_2$ is approximately equal to the amount deposited at the cathode during electrowinning, close to one half of all lead put into solution in an electrolyte must be reprocessed.

Evolution of oxygen at the anode prevents formation of $PbO_2$ because the $O_2$ is evolved instead of reacting with the lead in solution to form $PbO_2$. However, the current densities required to evolve oxygen are generally much higher than those necessary to produce good cathode deposits. Further, current densities of 200–500 A/sq. ft. while too low to eliminate the formation of $PbO_2$, often cause decomposition of the insoluble anodes or cause other problems at electrode connections. Use of an unbalanced electrode arrangement with the anode much smaller than the cathode is sometimes resorted to to facilitate oxygen evolution and reduce lead peroxide reduction. None of the above measures, however, satisfactorily overcomes the problem of lead peroxide formation.

SUMMARY OF THE INVENTION

This invention relates to an improved electrolyte and process for electrowinning lead. The electrolyte comprises an inorganic acid solution in which a sufficient amount of an arsenic compound is dissolved to produce gassing at the anode during electrolysis. Preferably a solution containing at least 250 ppm of arsenic ion, and more preferably at least 650 ppm, is employed in a fluoboric, fluosilicic or nitric acid electrolyte. The process of the invention comprises electrowinning lead from such an electrolyte while maintaining the arsenic ion concentration at the specified levels. By means of the invention lead peroxide formation on the anode is reduced or eliminated.

DETAILED DESCRIPTION OF THE INVENTION

This invention relates to an improved electrolyte and process for electrowinning lead. In accordance with the invention, an arsenic compound is dissolved in an electrolyte suitable for electrowinning lead. By means of such arsenic compound addition, oxygen gassing at the anode is enhanced when lead is electrowon from the electrolyte, thereby reducing the formation of lead peroxide at the anode.

More specifically, this invention comprises an acidic electrolyte solution in which an arsenic compound is dissolved in an amount sufficient to cause oxygen gassing at the anode during lead electrowinning. The invention also comprises a lead electrowinning process wherein an electrolyte containing such compounds is employed.

In the practice of the present invention, lead is electrowon from inorganic acid solutions. Typically the lead carbonate or monoxide is dissolved in the solution to form soluble salts with the acid.

Fluoboric, fluosilicic and nitric acid solutions are among the inorganic acid electrolytes which may be employed as lead electrowinning electrolytes. In such cases the $PbCO_3$ or PbO forms Pb $SiF_6$, $Pb(BF_4)_2$ or $Pb(NO_3)_2$. When pure acid solutions are employed, a hard, dense layer of $PbO_2$ is formed at the anode while Pb is deposited from the solution on the cathode during electrowinning. During such electrowinning the following reactions are involved.

Anode—

$$PbSiF_6+2H_2O \rightarrow PbO_2+2H^+ +H_2SiF_6+2e^-$$

$$Pb(BF_4)_2+2H_2O \rightarrow PbO_2+2H^+ +2HBF_4+2e^-$$

$$Pb(NO_3)_2+2H_2O \rightarrow PbO_2+2H^+ +2HNO_3+2e^-$$

Cathode—

$$PbSiF_6+2H^+ +2e^- \rightarrow Pb+H_2SiF_6$$

$$Pb(BF_4)_2+2H^+ +2e^- \rightarrow Pb+2HBF_4$$

$$Pb(NO_3)_2+2H^+ +2e^- \rightarrow Pb+2HNO_3$$

The overall reactions are thus:

$$2PbSiF_6+2H_2O \rightarrow PbO_2+Pb+2H_2SiF_6$$

$$2Pb(BF_4)_2+2H_2O \rightarrow PbO_2+Pb+4HBF_4$$

$$2Pb(NO_3)_2+2H_2O \rightarrow PbO_2+Pb+4HNO_3$$

In essence, one mole of $PbO_2$ is created for each mole of lead deposited.

Where, however, arsenic ions are dissolved in the fluosilicic, fluoboric or nitric acid electrowinning solution, $O_2$ is evolved at the anode rather than reacting with the $PbSiF_6$, $Pb(BF_4)_2$ or $Pb(NO_3)_2$ to produce $PbO_2$. The overall reactions now become:

$$2PbSiF_6+2H_2O \rightarrow 2Pb+2H_2SiF_6+O_2$$

$$2Pb(BF_4)_2+2H_2O \rightarrow 2Pb+4HBF_4+O_2$$

$$2Pb(NO_3)_2+2H_2O \rightarrow 2Pb+4HNO_3+O_2$$

Thus, where one employs the electrolyte and process of the invention lead peroxide formation at the anode is reduced and the need to recycle and reprocess substantial amounts of lead from the anode deposit is avoided.

In addition to the above-noted inorganic acid electrolytes, sulfamic acid solutions may also be employed in the practice of the present invention. When such electrolyte is employed without the additives of the present invention, lead sulfate and lead peroxide form on the anode without gassing. In contrast, the inclusion of the additives of the present invention in the electrolyte causes gassing and results in the reduction or elimination of lead peroxide formation on the anode. Further the formation of lead sulfate on the anode in the electrolyte solution is avoided; rather the lead sulfate is formed in the solution or on the anode at the solution line in the practice of the present invention employing a sulfamic acid electrolyte.

The arsenic materials, whose presence has been found effective in reduction of lead peroxide formation, are those which are sufficiently soluble in the electrolytes employed to provide the requisite level of arsenic ions, as hereinbelow discussed. Materials such as arsenic trifluoride, arsenic trioxide, arsenic trichloride and arsenic pentoxide, produce gassing when dissolved in the electrowinning solutions. The mechanism by which addition of arsenic ions to lead electrowinning electrolytes reduces or eliminates lead peroxide formation at the anode is not understood. However, it is believed that oxidation of the arsenic material may be involved.

Although the reaction mechanism is not understood, it is clear that the material employed must be dissolved in the electrolyte solution during electrowinning. Thus, arsenic coated electrodes do not produce the desired effects. Although selenium materials are soluble and initially causing gassing at the anode, they are depleted from the solution rapidly and lead peroxide deposition thereupon occurs. Moreover, poor lead deposits having high selenium contents occur at the cathode, rendering selenium materials impractical in the practice of the present invention.

The arsenic ions must be added to the electrolyte in an amount at least sufficient to cause gassing at the anode. Typically, at least about 250 ppm (0.250 g/l) arsenic ion must be present for any gassing to occur. At levels of about 500 ppm significant reduction in $PbO_2$ formation is generally effected. Preferably, at least about 650 ppm arsenic ion is employed since at this level gassing occurs at a rate sufficient to substantially eliminate lead peroxide formation in inorganic acid solutions. Thus, arsenic levels of about 650 ppm to about 750 ppm and above are sufficient to prevent the substantial deposit of $PbO_2$ at the anode which occurs in solutions with lower arsenic ion contents. At sufficiently high levels of arsenic ion, it may be possible to completely eliminate lead peroxide deposition on the anode.

As the arsenic content is increased beyond 250 ppm, the $PbO_2$ deposit changes from a hard, dense, glossy black deposit to a very fine, red, brown deposit. At 650 ppm, the small amount of deposit formed is of the red-brown type and there is little or no dark, glossy deposit formed.

There appears to be no direct correlation between arsenic content of the metal deposit and amount of arsenic in solution, current densities, lead concentrations and the like. Under the conditions employed, the arsenic content of the deposits on the cathode varied between <0.001% and 0.020%. At the 650 ppm arsenic level of the solution, the arsenic content of the lead deposit is generally only on the order of 0.0075%. At these levels the arsenic can easily be removed from the lead by normal refining techniques.

There is generally no need to supply additional arsenic during electrowinning since the arsenic generally is not consumed in the reaction. However, since some may deposit on the cathode along with the lead during electrowinning and some may also be entrained in any $PbO_2$ deposit on the anode, it may be necessary to occasionally replenish the arsenic.

In the present electrowinning process, the arsenic ion may simply be added to the electrolyte as a soluble arsenic salt. Alternatively arsenic removed from the cathode lead deposit as an oxide in the refining process may be recycled back to the electrolyte by merely leaching the dross. In addition, some battery sludge may contain sufficient arsenic to maintain the desired amount in the electrolyte without supplementation.

The following examples are illustrative of the invention:

EXAMPLE 1

The effects of arsenic ion additions on the amount of $PbO_2$ deposited on the anode and on the condition of the lead deposit on the cathode were tested by adding incremental amounts of arsenic to a 16% $HBF_4$ solution containing 10 g/l $H_3BO_3$ and 0.2 g/l glue and having a lead content of about 150 g/l. Graphite anodes and cathodes of 316 stainless steel were employed. All tests were carried out at 72° F., 5.5 amps and 2.5 volts resulting in an anode current density of 24.75 A/sq. ft. on the 4"×4" anode.

As seen in Table 1, at arsenic contents of up to about 100 ppm, the ratio of $PbO_2$ deposited on the anode to Pb deposited is constant and about 1.2. At higher arsenic levels the amount of $PbO_2$ deposited on the anode decreases until at arsenic contents of about 650 ppm only a very small amount of $PbO_2$ is formed. Virtually no gassing at the anode occurred during tests 1, 2 and 3. In test 4 there was a small amount of gassing, while in test 6 the anode gassed freely and no evidence of $PbO_2$ buildup on the anode could be seen.

TABLE 1

| Test No. | Arsenic Content PPM | Time Hrs | Wt. Of Pb Deposit gr | Wt. Of $PbO_2$ Deposit gr | $PbO_2$ / Pb Ratio | As Content Pb Deposit (%) |
|---|---|---|---|---|---|---|
| 1 | 24.3 | 4 | 82.6 | 99.6 | 1.21 | — |
| 2 | 50.0 | 4 | 80.6 | 98.2 | 1.22 | .0018 |
| 3 | 113.1 | 4 | 86.8 | 103.2 | 1.29 | .0016 |
| 4 | 269.0 | 4 | 80.5 | 74.1 | .92 | .0066 |
| 5 | 463.0 | 5 | 99.1 | 24.5 | .25 | .0065 |
| 6 | 648 | 7.5 | 151.3 | 2.2 | .015 | .0075 |

The results in Table 1 indicate that at arsenic ion levels above about 250 ppm the amount of $PbO_2$ deposited on the anode begins to be reduced. Above about 650 ppm arsenic only negligible amounts of $PbO_2$ are deposited.

EXAMPLE 2

Lead was electrowon from a 23% solution of fluosilicic acid electrolyte containing 4 g/l of glue and having the arsenic ion content and lead contents indicated in Table 2. The arsenic ions were derived from $As_2O_3$ in runs 1, 3, 4 and 5 while $As_3O_5$ and $AsF_3$ were employed in runs 2 and 6 respectively. All tests were run at 2.6 Volts. The results are set forth in Table 2.

TABLE 2

| Run | As Content | Pb Content | Anode $PbO_2$ (gm) | Cathode Pb (gm) | $PbO_2/Pb$ | Amps | Time HR |
|---|---|---|---|---|---|---|---|
| 1 | 0.002 g/l | 120 g/l | 92.6 | 77.9 | 1.19 | 5.5 | 4 |
| 2 | 0.280 g/l | 120 g/l | 26.5 | 78 | .33 | 5.0 | 4 |
| 3 | 0.496 g/l | 120 g/l | 10.8 | 68.3 | 0.16 | 5.5 | 3.5 |
| 4 | 0.750 g/l | 110 g/l | 1.0 | 247.0 | 0.004 | 5.0 | 13 |
| 5 | 0.98 g/l | 267 g/l | 0.9 | 83.2 | 0.01 | 5.0 | 4.5 |
| 6 | 1.55 g/l | 49 g/l | 0 | 85.9 | 0 | 5.0 | 4.5 |

The results of these runs indicate that increasing arsenic ion levels, regardless of the source of the arsenic ion, effect reduction of $PbO_2$ deposition at the anode when lead is electrowon from a fluosilicic acid electrolyte.

EXAMPLE 3

The effects of arsenic ion presence during lead electrowinning at 2.6 Volts from a nitric acid electrolyte were tested under the conditions set forth in Table 3:

TABLE 3

| As Content | Pb Content | Anode $PbO_2$ (gm) | Cathode Pb(gm) | $PbO_2/Pb$ | Amps | Time HR |
|---|---|---|---|---|---|---|
| 0.300 g/l | 221 g/l | 21.9 | 67.5 | 0.32 | 5.0 | 3.5 |
| 0.750 g/l | 200 g/l | 4.9 | 113.8 | 0.04 | 5.0 | 6.0 |

Although slightly higher levels of arsenic ion are required to minimize lead peroxide deposition from this electrolyte, presence of arsenic ion resulted in reduced lead peroxide deposition at the anode.

EXAMPLE 4

The effects of arsenic ion on the deposition of lead peroxide at the anode during lead electrowinning from acetic acid was tested. Very little gassing was observed and poor lead cathode deposits resulted even when 1.00 g/l arsenic ion was added to the acetic acid electrolyte containing 100 g/l of lead. After electrolysis had been carried out for 4.0 hours at 2.0 amps and 4.5 volts, 35.1 g of $PbO_2$ had deposited at the anode and 28.6 g of Pb had deposited at the cathode, for a $PbO_2/Pb$ ratio of 1.22.

We claim:

1. A process for reducing lead peroxide formation when electrowinning lead from an inorganic acid electrolyte, which comprises dissolving at least 250 ppm of arsenic ion in the electrolyte and thereafter electrowinning the lead while maintaining an arsenic ion concentration of at least 250 ppm.

2. The process of claim 1 wherein at least 650 ppm of arsenic ion are dissolved in the electrolyte and the concentration is maintained at at least 650 ppm.

3. The process of claim 1 wherein the electrolyte comprises a fluoboric acid solution.

4. The process of claim 1 wherein the electrolyte comprises a fluosilicic acid solution.

5. The process of claim 1 wherein the electrolyte comprises a nitric acid solution.

6. The process of claim 1 wherein the electrolyte comprises a sulfamic acid.

7. In a process for electrowinning lead from an inorganic acid electrolyte containing the lead as dissolved salts employing an insoluble anode, the improvement which comprises dissolving and maintaining in the electrolyte sufficient arsenic ion to cause gassing at the anode during electrowinning.

8. The process of claim 7 wherein at least 500 ppm of arsenic ion are dissolved in the electrolyte.

9. The process of claim 7 wherein at least 650 ppm of arsenic ion are dissolved in the electrolyte.

10. The process of claim 7 wherein the electrolyte is selected from the group consisting of fluoboric, fluosilicic nitric and sulfamic acids.

11. An improved inorganic acid electrolyte for electrowinning lead, characterized in that the electrolyte contains arsenic ion in an amount sufficient to cause gassing at the anode during electrolysis.

12. The electrolyte of claim 11 which contains at least 500 ppm of arsenic ions.

13. The electrolyte of claim 11 which contains at least 650 ppm of arsenic compound.

14. The electrolyte of claim 11 wherein the electrolyte is selected from the group consisting of fluoboric, fluosilicic, nitric and sulfamic acid solutions.

* * * * *